United States Patent [19]

Grille

[11] Patent Number: 4,760,720

[45] Date of Patent: Aug. 2, 1988

[54] PADLOCK PROTECTOR

[76] Inventor: Juan Grille, 116 E. 51 Place, Hialeah, Fla. 33013

[21] Appl. No.: 23,837

[22] Filed: Mar. 9, 1987

[51] Int. Cl.[4] ..... E05B 67/38

[52] U.S. Cl. ..... 70/54; 70/56; 70/417

[58] Field of Search ..... 70/56, 54, 55, 51, 52, 70/417

[56] References Cited

U.S. PATENT DOCUMENTS

| | | | |
|---|---|---|---|
| 3,800,570 | 4/1974 | Kaplan | 70/18 |
| 3,808,847 | 5/1974 | Vesely | 70/18 |
| 4,033,155 | 7/1977 | De Lucia | 70/56 |
| 4,112,716 | 9/1978 | Wippich | 70/52 X |
| 4,122,693 | 10/1978 | Barr | 70/56 |
| 4,535,612 | 8/1985 | Seremet | 70/56 |
| 4,576,022 | 3/1986 | Gamble | 70/417 X |

*Primary Examiner*—Gary L. Smith
*Assistant Examiner*—Suzanne L. Dino
*Attorney, Agent, or Firm*—Jesus Sanchelima

[57] ABSTRACT

A padlock protector comprising a housing member and a locking rod rigidly mounted, offcentered, inside the housing. The locking rod cooperates with the shackle of a padlock to secure the latter inside the housing when the padlock is fastened to a latching device. The housing member is provided with cooperative cut-out portions at one end thereof for receiving the hardware members of the latching device when the padlock is fastened to the latching device.

2 Claims, 1 Drawing Sheet

PADLOCK PROTECTOR

BACKGROUND OF THE INVENTION

1. Field of the Invention

The present invention relates to padlock protective devices, and more particularly, to a padlock protector designed to prevent intruders from breaking, cutting or otherwise tampering with the padlock.

2. Description of the Related Art

In the past, various types of protective devices have been designed for safeguarding padlocks commonly used in locks, doors and the like against thieves. However, some of these protective devices are difficult and expensive to install, and others leave areas of the padlock exposed, therefore permitting the cutting or breaking of the padlock.

Applicant believes that the closest reference corresponds to U.S. Pat. No. 4,122,693 issued to Rolla W. Barr on Oct. 31, 1978. However, it differs from the present invention because the protective device disclosed in said patent leaves areas of the padlock vulnerable, that is, areas that can be easily broken, sawn or cut.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a padlock protector which overcomes the problems associated with the prior art.

It is another object of this present invention to provide a padlock protector capable of encasing the padlock in such a manner that it is virtually impossible to damage said padlock with such instruments as saws, cutters, chisels and the like.

It is still another object of this invention to provide a padlock protector which comprises a housing member provided with cut-out portions at one end thereof, and a locking rod rigidly mounted, offcentered, inside the housing.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
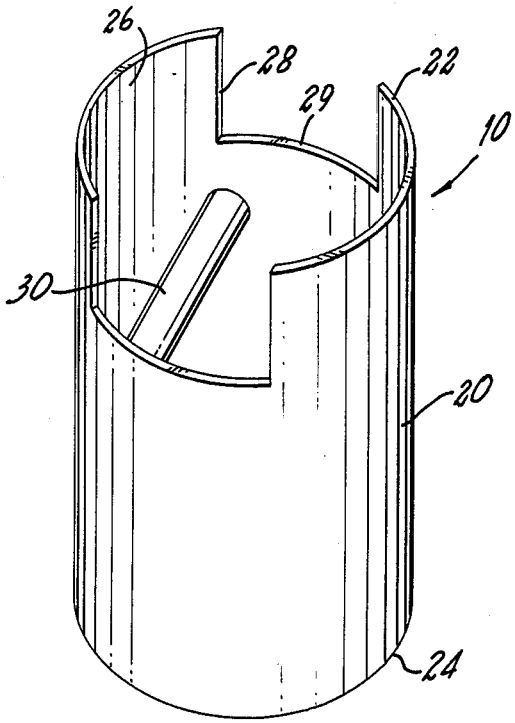
FIG. 1 represents a perspective view of the padlock protector.

Referring now to FIG. 1, it can be seen that the padlock protector, generally referred to with numeral 10, comprises a preferably cylindrical tubular housing member 20 having inner end 22 and outer end 24, and a locking rod 30 rigidly mounted, offcentered, to the inner wall 26 of housing member 20. An opening 25 is defined at end 24 by its rim in the preferred embodiment. Housing member 20 is provided with cut-out portions 28 at end 22 for receiving the hardware members of a latching device (not shown). The dimensions and shape of cut-out portions 28 are such that will conform to the type of latching device used.

Figure 2:
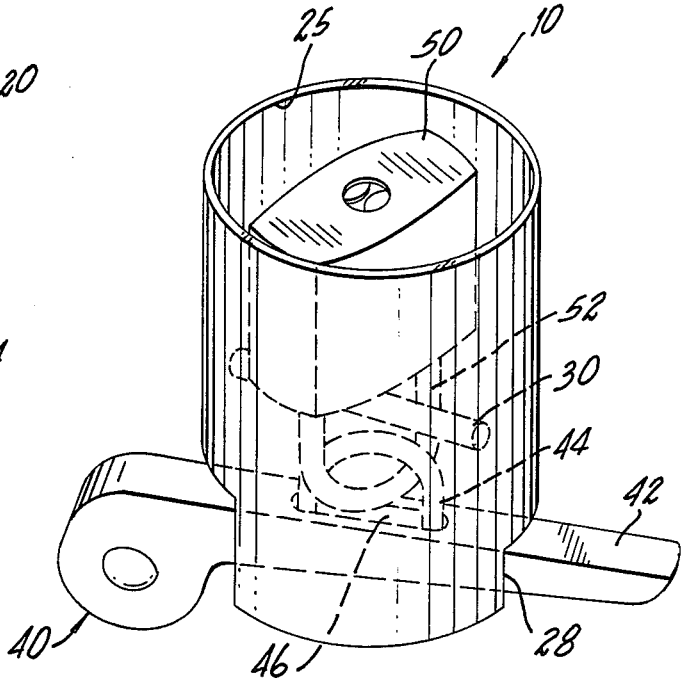
FIG. 2 shows a perspective view of the padlock protector of FIG. 1 secured to a conventional latching device by means of a padlock.

As seen in FIG. 2, locking rod 30 cooperates with shackle portion 52 of padlock 50 to secure padlock protector 10 to latching device 40. The width of padlock 50 being slightly smaller than the diameter of housing member 20. Locking rod 30 is mounted offcentered inside housing member 20 to facilitate the locking and unlocking of latching device 40. Rod 30 can be mounted perpendicularly to the longitudinal axis of tubular housing member 20. Rod 30 is mounted at any position between bottom edge 29 of cut-out portions 28 and outer end 24, depending on the type of padlock and latching device being used. Housing member 20 and locking rod 30 can have a plurality of shapes, as long as padlock protector 10 provides the protection for which it has been designed, and can be made of any suitable hard material, preferably, high strength steel.

FIG. 2 is a perspective view showing padlock protector 10 secured to a conventional latching device 40. Latching device 40 includes a pivotally mounted handle member 42 and a U-shaped member 44, mounted doors or gates (not shown). Member 42 is provided with an opening 46 for permitting the passage of U-shaped member 44 when the door is closed. When the door is closed, padlock 50 is fastened to U-shaped member 44 and locking rod 30 by means of shackle 52. Padlock protector 10 then encases padlock 50, and handle member 42 is received into cut-out portions 28. This type of arrangement fully protects padlock 50 and U-shaped member 44, making it practically impossible to cut, saw or break padlock 50 or member 44.

Figure 3:
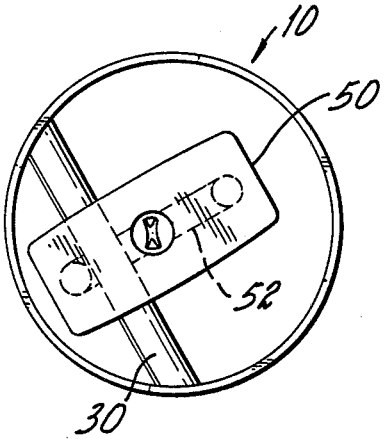
FIG. 3 illustrates a top view of the padlock protector of FIG. 2 showing the padlock fastened to the locking rod of the padlock protector.

FIG. 3 is a top view of the padlock protector 10 of FIG. 2 showing the relative position of padlock 50 fastened to locking rod 30.

Figure 4:
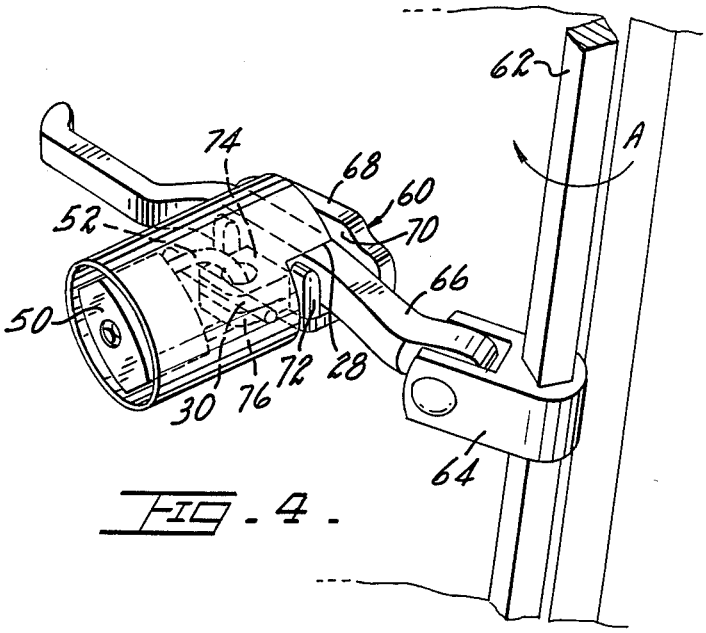
FIG. 4 is a representation of a perspective view showing the padlock protector secured to another conventional latching device by means of a padlock that is housed within the protector.

FIG. 4 is a perspective view showing padlock protector 10 (partially in phantom) secured to another conventional latching device 60. Latching device 60 includes a rotatably mounted bar 62 having rigidly attached thereto a fork-like member 64 on which a lever member 66 is pivotally mounted, and a support member 68. Bar 62 and support member 68 are mounted on doors or gates (not shown). In operation, bar 62 is rotated in the direction of arrow A by means of lever member 66 and the latter is forced downwardly into the space defined by wall 70 and projections 72 of support member 68. In this condition, tabs 74 and 76 in members 66 and 68, respectively, are in a face-to-face relationship, thereby permitting the insertion of shackle 52 of padlock 50 through the openings provided in tabs 74 and 76 to lock in latching device 60. When padlock 50 is fastened to tabs 74 and 76 and locking rod 30, padlock protector 10 encases padlock 50 and portions of members 66 and 68 are received into cut-out portions 28. By virtue of this arrangement padlock protector is protected against any intruder trying to cut, saw or otherwise break padlock 50.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A device for protecting padlocks having a shackle member and being removably secured to a latching device, comprising:

A. a tubular cylindrical housing member substantially enclosing said padlock having an inner and an outer end and an inner surface and said housing including cut out portions on said inner end that cooperatively conforms with the shape and dimensions of said latching device the diameter of said inner surface being slightly larger than the width of the padlock; and B. a locking rod mounted to said inner surface perpendicularly to the longitudinal axis of said tubular housing member and sufficiently close to said inner end so that when said housing member is positioned over said padlock and said rod being mounted within a sufficient close proximity to said latching device to allow said shackle to secure said latching device and said rod and at the same time sufficiently separated from said cut out portions so that exposure of said shackle member.

2. The device set forth in claim 1 wherein said cut out portions have a rectangular shape.

* * * * *